US010561567B2

(12) United States Patent
Lopez

(10) Patent No.: US 10,561,567 B2
(45) Date of Patent: Feb. 18, 2020

(54) WALKING AND SOCK ASSISTING DEVICE

(71) Applicant: Anthony Raymond Lopez, Middleburg, FL (US)

(72) Inventor: Anthony Raymond Lopez, Middleburg, FL (US)

( * ) Notice: Subject to any disclaimer, the term of this patent is extended or adjusted under 35 U.S.C. 154(b) by 0 days.

(21) Appl. No.: 15/950,561

(22) Filed: Apr. 11, 2018

(65) Prior Publication Data

US 2019/0314237 A1 Oct. 17, 2019

(51) Int. Cl.
*A61H 3/00* (2006.01)
*A47G 25/90* (2006.01)

(52) U.S. Cl.
CPC ..... *A61H 3/00* (2013.01); *A47G 25/907* (2013.01); *A61H 2201/0157* (2013.01); *A61H 2201/0192* (2013.01)

(58) Field of Classification Search
CPC ..... A61H 3/00; A61H 3/0288; A61H 2201/0192; A61H 2003/0222; A61H 2003/0211; A61H 2201/0157; A47G 25/907; A47G 25/90
USPC .... 135/65–66, 75, 77, 80, 84; 223/118–119, 223/111–112
See application file for complete search history.

(56) References Cited

U.S. PATENT DOCUMENTS 594,894 A * 12/1897 Nylander ..... A47G 25/82 223/118
1,339,257 A * 5/1920 Callahan ..... A45B 3/00 135/66
3,912,316 A * 10/1975 Veech ..... E01H 1/1206 294/1.4
4,709,839 A * 12/1987 Tucker ..... A47G 25/82 223/119
5,390,687 A * 2/1995 Tsai ..... A61H 3/02 135/65
5,794,638 A * 8/1998 Richey ..... A61H 3/02 135/65
6,283,342 B1 * 9/2001 Wilkerson ..... A47G 25/82 223/111
6,328,048 B1 * 12/2001 Rivera, Sr. ..... A45B 3/00 135/66
8,371,320 B1 * 2/2013 McKenna ..... A61H 3/02 135/71
D679,888 S * 4/2013 Sanchez-Garcia ..... D2/641
2015/0083761 A1 * 3/2015 Clifton ..... A47G 25/82 223/118
2016/0001442 A1 * 1/2016 Buzby ..... A47F 13/06 294/198

* cited by examiner

*Primary Examiner* — Winnie Yip
(74) *Attorney, Agent, or Firm* — Roy L. Chan, A Professional Law Corporation; Roy Chan

(57) ABSTRACT

A walking and sock assisting device comprising a lower portion and an upper portion. The lower portion comprises a left prong, a right prong, and a lower stem. The left prong comprises a left sock end, a left base, and a left stem end. The right prong comprises a right sock end, a right base, and a right stem end. The upper portion comprises a handle and an upper stem. The left stem end is coupled to the lower stem. The right stem end is coupled to the lower stem. The left sock end and the right sock end are configured to accept a sock. The left sock end and the right sock end are configured to expand the sock to allow a wearer to place a foot into the sock.

17 Claims, 4 Drawing Sheets

WALKING AND SOCK ASSISTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention is related to walking assisting devices and sock assisting devices. Some sock wearers may have difficulty putting on their socks due to a variety of reasons, including, but not limited to, lack of flexibility, injury, illness, age, or other reasons. For example, the sock wearer may have a back injury that prevents the sock wearer from bending without discomfort. The present invention assists the sock wearers in putting on their socks.

BRIEF SUMMARY OF THE INVENTION

An object of the present invention is a walking and sock assisting device comprising a lower portion and an upper portion. The lower portion comprises a left prong, a right prong, and a lower stem. The left prong comprises a left sock end, a left base, and a left stem end. The right prong comprises a right sock end, a right base, and a right stem end. The upper portion comprises a handle and an upper stem. The left stem end is coupled to the lower stem. The right stem end is coupled to the lower stem. The left sock end and the right sock end are configured to accept a sock. The left sock end and the right sock end are configured to expand the sock to allow a wearer to place a foot into the sock.

In another object of the present invention, the lower portion and the upper portion are integrally formed.

In yet another object of the present invention, the right prong further comprises a right prong angle formed between the right sock end and the right base; and, the left prong further comprises a left prong angle formed between the left sock end and the left base.

In another object of the present invention, the right prong angle is from 110 degrees to 155 degrees; and, the left prong angle is from 110 degrees to 155 degrees.

In yet another object of the present invention, the right prong angle is 110 degrees; and, the left prong angle is 110 degrees.

In another object of the present invention, the right prong angle is 135 degrees; and, the left prong angle is 135 degrees.

In yet another object of the present invention, the right prong angle is 155 degrees; and, the left prong angle is 155 degrees.

In another object of the present invention, the walking and sock assisting device further comprises a grip. The grip is coupled to the handle.

In yet another object of the present invention, the lower portion is removably attached to the upper portion. The walking and sock assisting device further comprises a means for removably attaching the lower portion to the upper portion.

In another object of the present invention, the means for removably attaching the lower portion to the upper portion comprises a plurality of apertures on the upper stem; and, a resilient locking button on the lower stem. The resilient locking button is adapted to be releasably engaged to each of the plurality of apertures.

In yet another object of the present invention, the walking and sock assisting device further comprises a stabilizer. The upper stem comprises a connector end. The stabilizer is coupled to the connector end.

BRIEF DESCRIPTION OF THE SEVERAL VIEWS OF THE DRAWING

The advantages and features of the present invention will be better understood as the following description is read in conjunction with the accompanying drawings, wherein.

Figure 1:
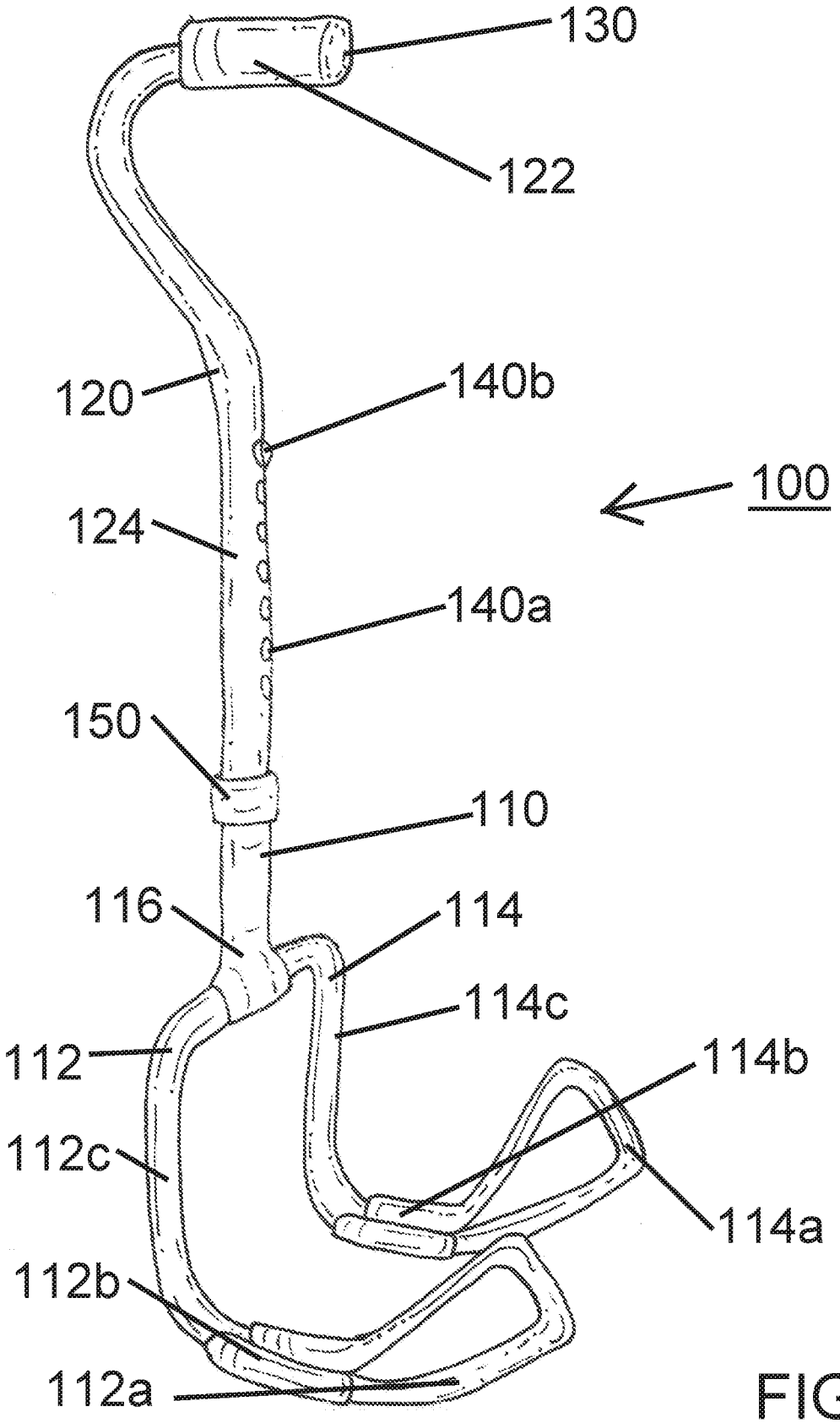
FIG. 1 is a perspective view of an embodiment of the present invention.

For clarity purposes, all reference numerals may not be included in every figure.

Figure 4:
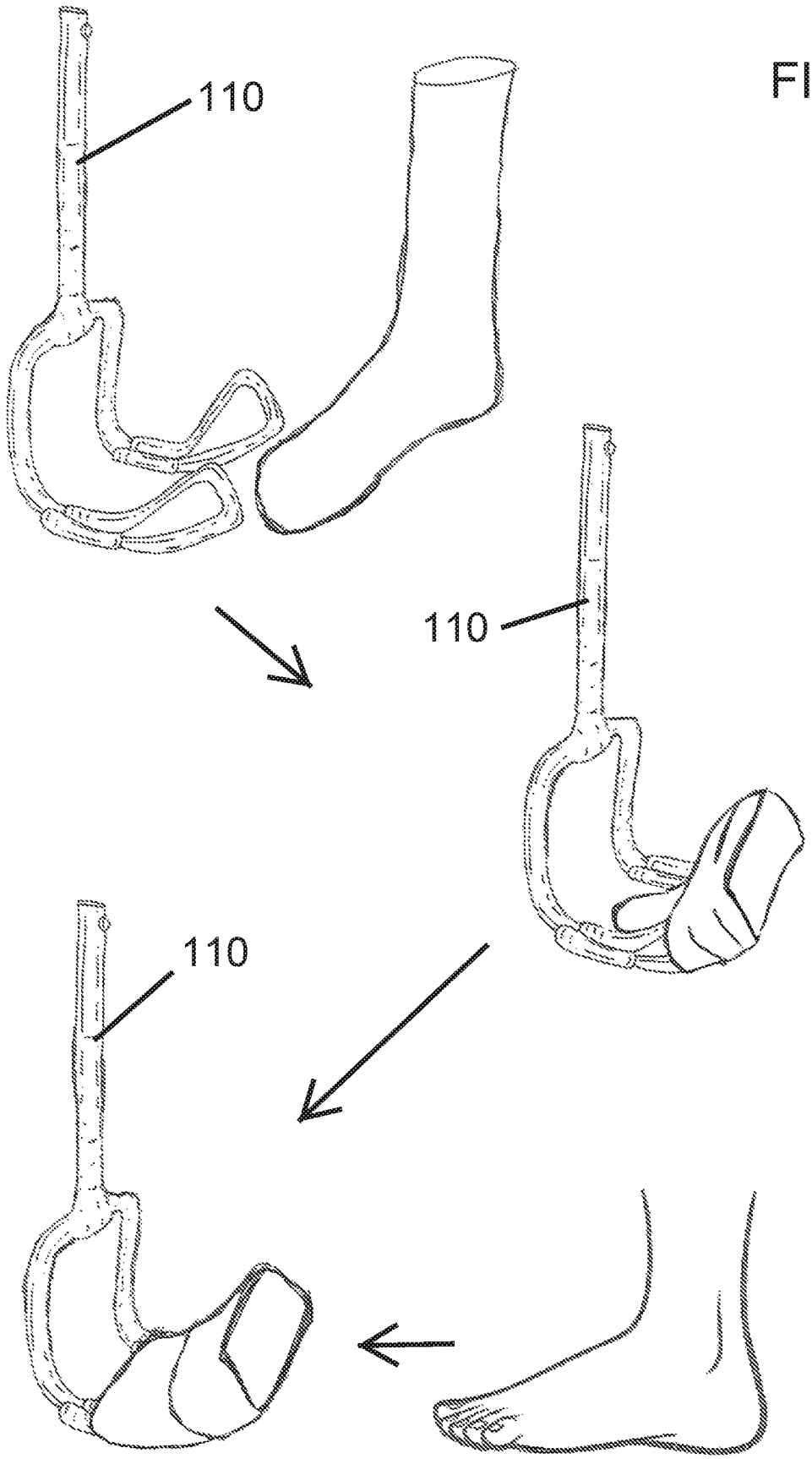

FIG. 4 is a perspective view of an embodiment of the present invention.

DETAILED DESCRIPTION OF THE INVENTION

The figures illustrate various embodiments of a walking and sock assisting device 100 comprising a lower portion 110 and an upper portion 120. The lower portion 110 comprises a left prong 112, a right prong 114, and a lower stem 116. The left prong 112 comprises a left sock end 112*a*, a left base 112*b*, and a left stem end 112*c*. The right prong 114 comprises a right sock end 114*a*, a right base 114*b*, and a right stem end 114*c*. The upper portion 120 comprises a handle 122 and an upper stem 124. The left stem end 112*c* is coupled to the lower stem 116. The right stem end 114*c* is coupled to the lower stem 116. The left sock end 112*a* and the right sock end 114*a* are configured to accept a sock. The left sock end 112*a* and the right sock end 114*a* are configured to expand the sock to allow a wearer to place a foot into the sock.

As illustrated, both the left sock end 112*a* and the right sock end 114*a* are configured to accept a sock, where a wearer or someone assisting the wearer may slide a sock inside-out over the left sock end 112*a* and the right sock end 114*a* until the inside of closed toe tip of the sock is visible. This allows the wearer to place her toes in the toe tip and the walking and sock assisting device 100 is moved towards the ankle, then up towards the knee until the sock is in place over the wearer's foot and leg.

In some embodiments, the lower portion 110 and the upper portion 120 may be integrally formed.

In some embodiments, the lower portion 110 may be removably attached to the upper portion 120. The walking and sock assisting device 100 may further comprise a means for removably attaching the lower portion 110 to the upper portion 120.

Figure 2:
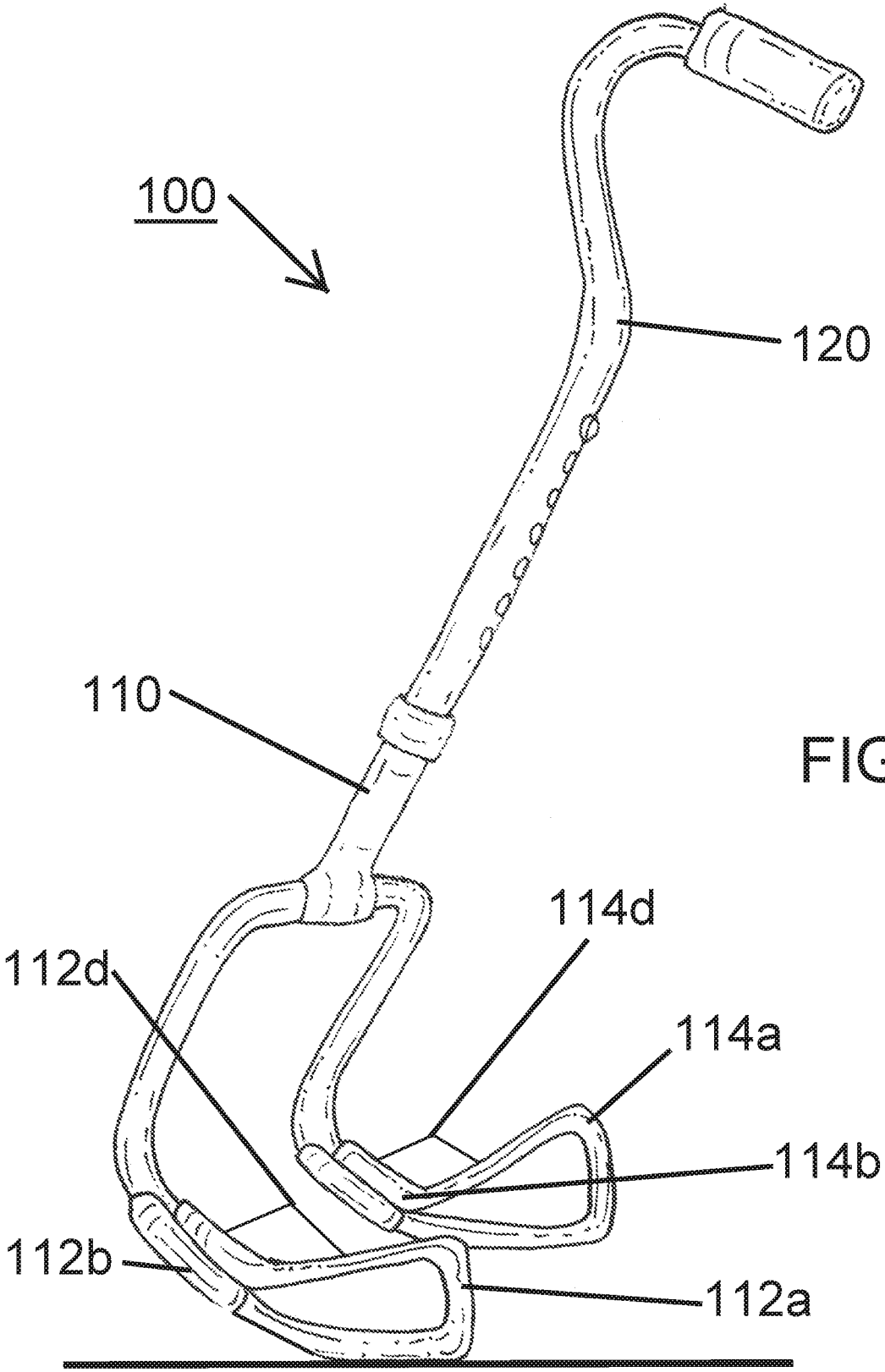
FIG. 2 is a perspective view of an embodiment of the present invention.
Figure 3:
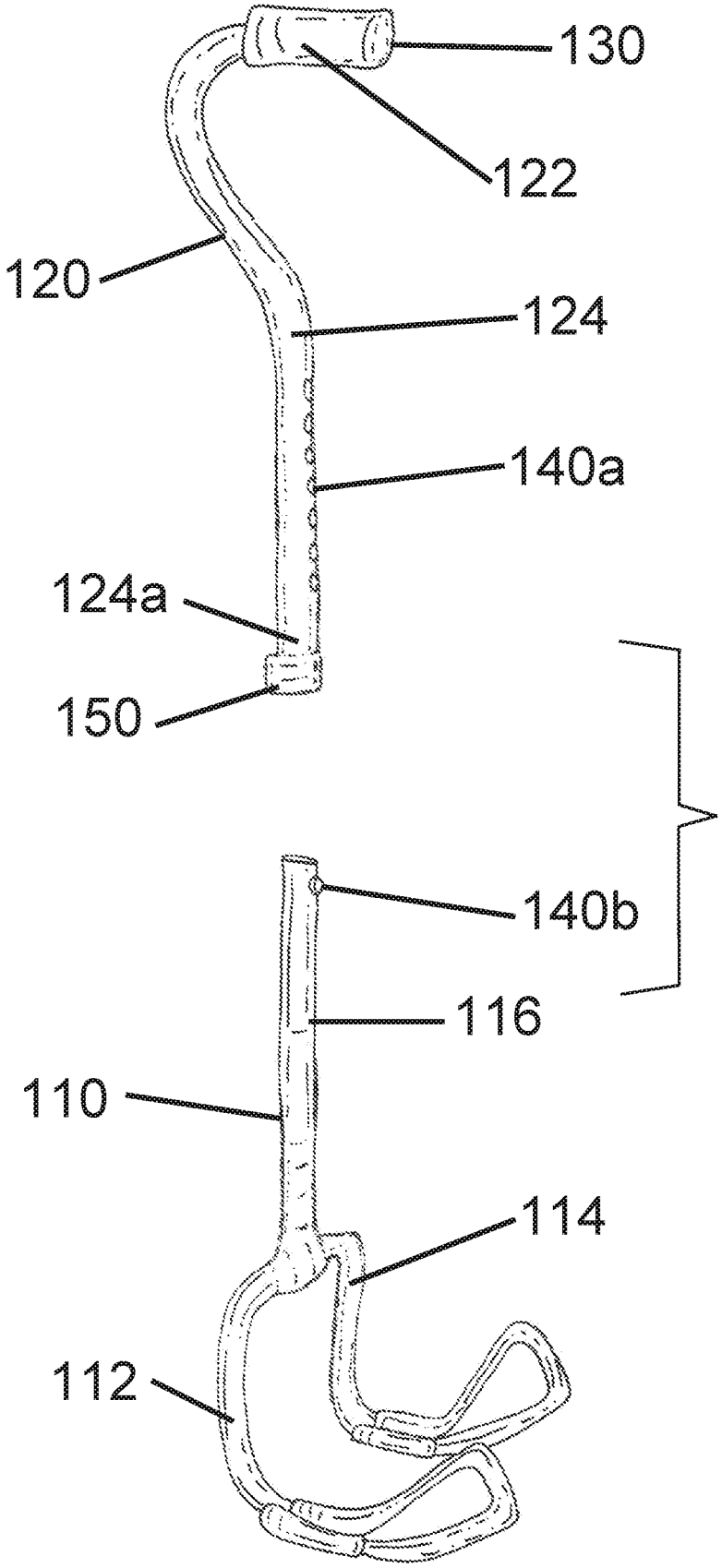
FIG. 3 is an exploded view of an embodiment of the present invention.

In some embodiments, the means for removably attaching the lower portion 110 to the upper portion 120 may comprise a plurality of apertures 140*a* on the upper stem 124 and a resilient locking button 140*b* on the lower stem 116. The resilient locking button 140*b* may be adapted to be releasably engaged to each of the plurality of apertures 140*b*. FIG. 3 illustrates the lower portion 110 separated from the upper portion 120. FIGS. 1 and 2 illustrate the lower portion 110 removably attached from the upper portion 120. The length of the walking and sock assisting device 100 may be adjusted to suit the comfort of the wearer by locking the resilient locking button 140*b* the most appropriate aperture 140*a* for the wearer.

Although the figures illustrate means for removably attaching the lower portion 110 to the upper portion 120 as utilizing a plurality of apertures 140*a* on the upper stem 124 and a resilient locking button 140*b* on the lower stem 116, one of ordinary skill in the art understands that the scope of the present invention includes other means for removably attaching the lower portion 110 to the upper portion 120. Such means include, but are not limited to, screw and thread, reusable pin and holes, and twist lock mechanisms.

In some embodiments, the walking and sock assisting device 100 may further comprise a stabilizer 150. As illustrated in FIG. 3, the upper stem may comprise a connector end 124*a*. The stabilizer 150 is coupled to the connector end 124*a*. The stabilizer 150 may act to stabilize and strengthen the joint or connection between the lower portion 110 and the upper portion 120.

In some embodiments, as illustrated in FIG. 2, the right prong 114 may further comprise a right prong angle 114*d* formed between the right sock end 114*a* and the right base 114*b*; and, the left prong 112 may further comprise a left prong angle 112*d* formed between the left sock end 112*a* and the left base 112*b*.

In some embodiments, the right prong angle 114*d* may be from 110 degrees to 155 degrees. The left prong angle 112*d* may be from 110 degrees to 155 degrees.

In some embodiments, the right prong angle 114*d* is 110 degrees and the left prong angle 112*d* is 110 degrees.

In some embodiments, the right prong angle 114*d* is 135 degrees and the left prong angle 112*d* is 135 degrees.

In some embodiments, the right prong angle 114*d* is 155 degrees and the left prong angle 112*d* is 155 degrees.

In some embodiments, the walking and sock assisting device 100 may further comprise a grip 130. The grip 130 may be coupled to the handle 122.

As illustrated in FIG. 1, the walking and sock assisting device 100 may stand on the left base 112*b* and the right base 114*b*. Alternatively, as illustrated in FIG. 2, the walking and sock assisting device 100 may stand on the left sock end 112*a* and the right sock end 114*a*. These alternatives allow for use of the walking and sock assisting device 100 by different the wearers based upon comfort for the wearer and ease of use of the walking and sock assisting device 100. For example, when the wearer is seated and if the wearer's feet do not touch the ground, it may be more comfortable for the wearer and easier to use the walking and sock assisting device 100 if the walking and sock assisting device 100 is standing on the left base 112*b* and the right base 114*b*, which situates the left sock end 112*a* and the right sock end 114*a* at an angle that may be better for the wearer to put on a sock.

The term "socks" include, but is not limited to, socks, hosiery, compression socks, nylons, stockings, compression stockings, legwear, leggings, breeches, leg warmers, and other garments worn directly on the feet and legs.

The lower portion 110 and the upper portion 120 of the walking and sock assisting device 100 may be made of a lightweight and strong material, including, but not limited to, metal and plastics. Furthermore, the lower portion 110 and the upper portion 120 may be tubular and/or hollow.

Although the left sock end 112*a* and right sock end 114*a* are illustrated as having square ends, one of ordinary skill in the art understands that the scope of the present invention includes the left sock end 112*a* and right sock end 114*a* having other shapes, such as being rounded.

In some embodiments, the left sock end 112*a* and right sock end 114*a* tapers towards the left base 112*b* and right base 114*b*, respectively. The tapering may aid in sliding and securing the sock onto the left sock end 112*a* and right sock end 114*a* when the wearer is putting the sock onto her foot.

In addition to assisting the wearer to put on socks, the walking and sock assisting device 100 may be used to assist the wearer while walking.

While the invention has been described with reference to exemplary embodiments, it will be understood by those skilled in the art that various changes, omissions, and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiments disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A walking and sock assisting device comprising:

a lower portion comprising:
- a left prong comprising:
- a left sock end;
- a left base; and,
- a left stem end;

a right prong comprising:
- a right sock end;
- a right base; and,
- a right stem end; and,
- a lower stem; and, an upper portion comprising:
- a handle; and,
- an upper stem;

wherein the left stem end is coupled to the lower stem;

wherein the right stem end is coupled to the lower stem;

wherein the left stem end extends upward from the left base;

wherein the right stem end extends upward from the right base;

wherein the lower stem and the upper stem together form an elongated shaft;

wherein the left and right bases or the left and right sock ends are configured to be placed on a surface to allow the elongated shaft in a stand position to assist a wearer to walk;

wherein the left sock end is parallel to the right sock end;

wherein the left sock end and the right sock end are configured to accept a sock; and, wherein the left sock end and the right sock end are configured to expand the sock to allow the wearer to place a foot into the sock.

2. The walking and sock assisting device of claim 1 wherein the lower portion and the upper portion are integrally formed.

3. The walking and sock assisting device of claim 2, wherein the right prong further comprises a right prong angle formed between the right sock end and the right base; and, wherein the left prong further comprises a left prong angle formed between the left sock end and the left base.

4. The walking and sock assisting device of claim 3, wherein the right prong angle is from 110 degrees to 155 degrees; and, wherein the left prong angle is from 110 degrees to 155 degrees.

5. The walking and sock assisting device of claim 4, wherein the right prong angle is 110 degrees; and, wherein the left prong angle is 110 degrees.

6. The walking and sock assisting device of claim 4, wherein the right prong angle is 135 degrees; and, wherein the left prong angle is 135 degrees.

7. The walking and sock assisting device of claim 4, wherein the right prong angle is 155 degrees; and, wherein the left prong angle is 155 degrees.

8. The walking and sock assisting device of claim 4 further comprising a grip, wherein the grip is coupled to the handle.

9. The walking and sock assisting device of claim 1 wherein the lower portion is removably attached to the upper portion; and, wherein the walking and sock assisting device further comprising a means for removably attaching the lower portion to the upper portion.

10. The walking and sock assisting device of claim 9 wherein the means for removably attaching the lower portion to the upper portion comprises:

a plurality of apertures on the upper stem; and, a resilient locking button on the lower stem;

wherein the resilient locking button is adapted to be releasably engaged to each of the plurality of apertures.

11. The walking and sock assisting device of claim 10 further comprising a stabilizer; and, wherein the upper stem comprises a connector end; and, wherein the stabilizer is coupled to the connector end.

12. The walking and sock assisting device of claim 11, wherein the right prong further comprises a right prong angle formed between the right sock end and the right base; and, wherein the left prong further comprises a left prong angle formed between the left sock end and the left base.

13. The walking and sock assisting device of claim 12, wherein the right prong angle is from 110 degrees to 155 degrees; and, wherein the left prong angle is from 110 degrees to 155 degrees.

14. The walking and sock assisting device of claim 13, wherein the right prong angle is 110 degrees; and, wherein the left prong angle is 110 degrees.

15. The walking and sock assisting device of claim 13, wherein the right prong angle is 135 degrees; and, wherein the left prong angle is 135 degrees.

16. The walking and sock assisting device of claim 13, wherein the right prong angle is 155 degrees; and, wherein the left prong angle is 155 degrees.

17. The walking and sock assisting device of claim 13 further comprising a grip, wherein the grip is coupled to the handle.

* * * * *